US006520804B2

(12) United States Patent
Sumida et al.

(10) Patent No.: US 6,520,804 B2
(45) Date of Patent: Feb. 18, 2003

(54) FUSE BOX DEVICE

(75) Inventors: Tatsuya Sumida, Yokkaichi (JP); Shunji Taga, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 09/726,340

(22) Filed: Dec. 1, 2000

(65) Prior Publication Data

US 2001/0012731 A1 Aug. 9, 2001

(30) Foreign Application Priority Data

Dec. 3, 1999 (JP) ..... 11-345350
Dec. 6, 1999 (JP) ..... 11-346240

(51) Int. Cl.[7] ..... H01R 13/68
(52) U.S. Cl. ..... 439/621; 337/227
(58) Field of Search ..... 439/621, 622, 439/682, 949, 76.2, 723; 337/227, 229, 256, 186, 187, 833; 361/837

(56) References Cited

U.S. PATENT DOCUMENTS 5,346,411 A * 9/1994 Nikkinen ..... 439/621
5,562,502 A * 10/1996 Kourimsky ..... 439/621
6,007,350 A * 12/1999 Isshiki ..... 439/76.2

FOREIGN PATENT DOCUMENTS

DE 19646264 5/1998
EP 0884750 12/1998
EP 0924734 6/1999
JP 5-299003 11/1993
JP 2000-30600 1/2000
JP 2000182506 6/2000

OTHER PUBLICATIONS

Patent Abstracts of Japan vol. 2000, No. 09, published on Oct. 13, 2000.
English Language Abstract of JP–2000–182506.
English Language Abstract of JP 5–299003.
English Language Abstract of JP 2000–30600.
English Language Abstract of JP 2000–182506.

* cited by examiner

*Primary Examiner*—P. Austin Bradley
*Assistant Examiner*—Phuong Nguyen
(74) *Attorney, Agent, or Firm*—Greenblum & Bernstein, P.L.C.

(57) ABSTRACT

A fuse box device is provided that includes a fuse box and a fuse unit contained therein. The fuse unit includes an input terminal directly connectable to a battery, several output terminals connectable to a wire harness, and several fuse element portions. One end of the fuse element portions is formed unitarily and in one piece with the input terminal, while the other end of the fuse element portions is formed unitarily and in one piece with the output terminals. The fuse unit is contained in the fuse box such that only the input terminal projects out of the fuse box. In such a construction, the fuse box device requires a reduced number of spare parts, so that production costs can be lowered. Moreover, the fuse box device is better suited to a miniaturization and less susceptible to assembly errors.

20 Claims, 8 Drawing Sheets

FIG.2 (a)
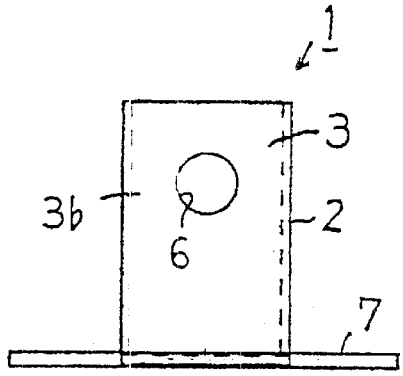
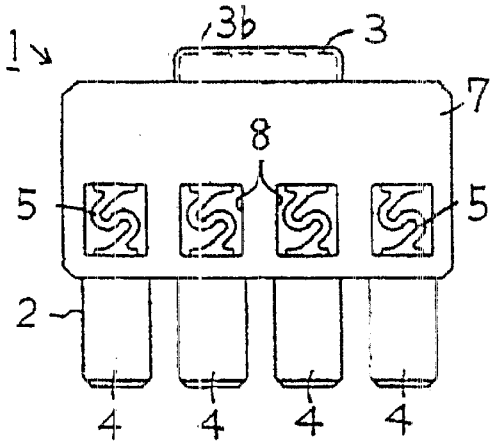
FIG.2 (b)
FIG.2 (c)
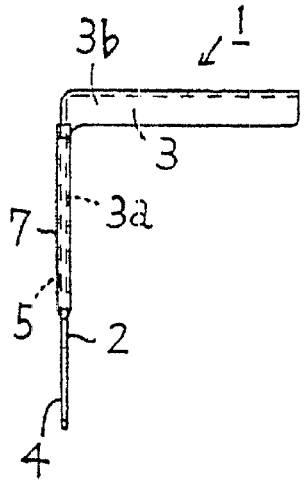
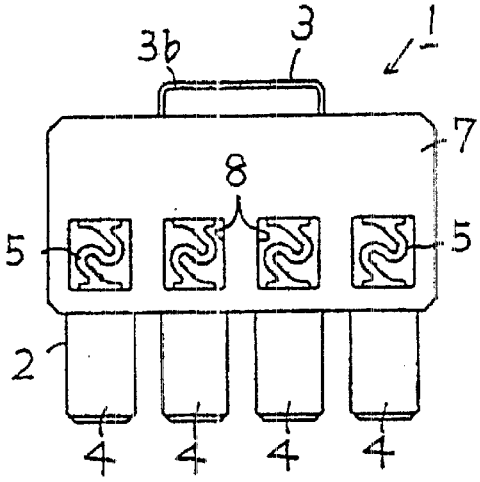
FIG.2 (d)

FIG.6 (d)
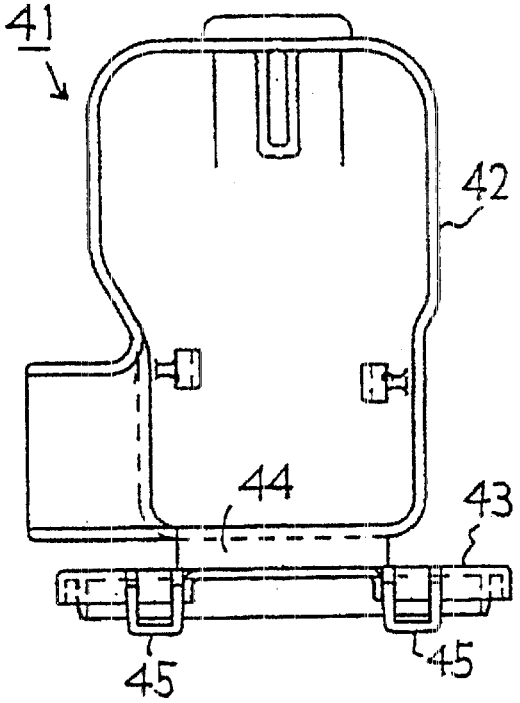
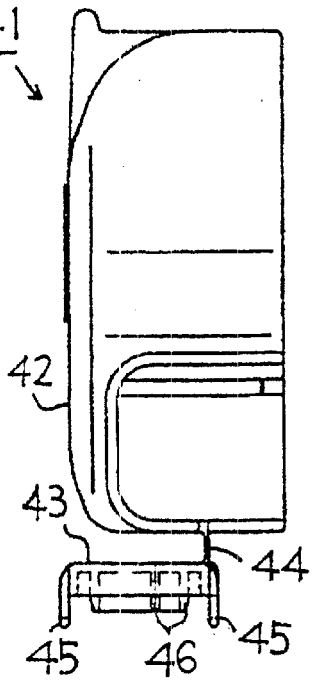
FIG.6 (e)
FIG.7
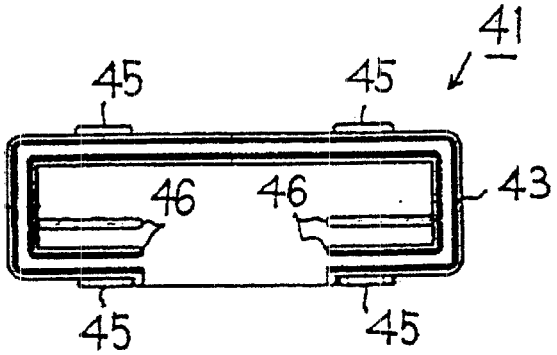

FUSE BOX DEVICE

BACKGROUND OF THE INVENTION

1. Field of the Invention

The present invention generally relates to a fuse box device including a fuse unit and a fuse box housing the latter. Such a fuse box device can usually be fitted directly to a battery mounted in automobiles.

2. Description of Background Information

An example of a known fuse box device is shown in FIG. 1. In this figure, the fuse box device 61 includes a fuse box 62, in which a plurality of flat fuses 63 are provided. The flat fuses 63 are formed of an electrically conductive metal plate, and each fuse includes a fuse element portion 64 interposed between two ear portions with a respective ear hole for bolting 65. The fuse box 62 is manufactured by molding a resin. The fuse box has a cavity 66 capable of containing a plurality of flat fuses 63. The base of the cavity 66 is provided with one or several flat input nuts 67 and flat output nuts 68. Both flat nuts 67 and 68 are insert-molded. The flat input nut 67 is fixed to a terminal which is directly attached to a battery (not shown in the figures). To this end, the flat input nut 67 has a nut hole for bolting. When a flat fuse 63 is mounted in the fuse box 62 and the nut hole is fitted with a bolt 69, a first end portion of the flat fuse 63 is connected and fixed to the flat input nut 67. Likewise, the flat output nut 68 has a nut hole for bolting. A second end portion of the flat fuse 63 is connected and fixed to the flat output nut 68 through a bolt 69 in the same manner.

In a wire harness 70 containing several electrical cables 71, each electrical cable 71 is fitted with an LA terminal 72 (or a ring terminal). The LA terminal 72 can thus be connected and fixed to the flat output nut 68 through the bolt 69, together with the flat fuse 63. Further, the fuse box 62 is protected by a fuse cover 73.

In the prior art, the flat fuses 63 and the terminal directly connectable to a battery were prepared separately, and fixedly connected to each other through flat input nuts 67 and bolts 69. Likewise, the flat fuses 63 and the LA terminals 72 were prepared separately, and connected to each other through flat output nuts 68 and bolts 69. Such a fixing mechanism necessarily increases the number of component parts used and, consequently, production costs.

In addition, such a process, carried out during manufacture, tends to cause spurious fixing, e.g., skewed fixing, or fixing was simply omitted fixing in some cases. To avoid such situations, a high level of process control has to be implemented.

In general, the size of flat input nuts 67 and flat output nuts 68 determines the total size of a fuse box device 61. However, there is a certain limit to miniaturizing of such flat nuts 67 and 68. Moreover, when a flat fuse 63 is to receive a large electric current, sufficiently large flat nuts 67 and 68 must be used in order to reduce electrical resistance. This in turn makes miniaturization more difficult.

The present invention has been contemplated in view of solving such problems. The fuse box device according to the present invention needs only a limited number of component parts and is better adapted to miniaturization than the conventional devices. Its construction is conceived such as to reduce fixing errors and can be implemented at lower costs.

SUMMARY OF THE INVENTION

To this end, there is provided a fuse box device including a fuse unit and a fuse box, the fuse unit including at least one fuse element portion having a first end portion and a second end portion. The first end portion is formed unitarily and in one piece with an input terminal directly connectable to a battery, while the second end portion is formed unitarily and in one piece with at least one output terminal connectable to a wire harness. The fuse unit is then contained in the fuse box such that only part or the entirety of the input terminal is positioned outside the fuse box.

Preferably, the fuse unit includes an insulator-molded portion covering at least a portion of the fuse element portions.

Preferably yet, the at least one output terminal includes a plurality of output terminals and the fuse box contains at least one insulator partition wall such as to define a plurality of enclosures, so that each enclosure contains an output terminal connectable to a press-fit terminal of one of the electrical cables which constitute a wire harness.

Suitably, the fuse box includes at least one holder for defining a fixing position for the fuse unit and fixing the latter in the fuse box by holding part of the fuse unit by the holder.

Typically, the fuse box includes two opposing inner faces, the insulator partition walls have a top portion, and the fuse box device further includes a cover joint having an inner face. The at least one holder is then selected from the group consisting of: at least one slit formed in the insulator partition walls so as to extend from the top portion thereof to a half-way point downward; two pairs of ribs formed in the opposing inner faces of the fuse box at positions corresponding to those of the slits; and two pairs of ribs formed in the inner face of the cover joint at positions corresponding to those of the slits.

In the above construction, the part of the fuse unit may include the insulator-molded portion.

According to a first aspect of the invention, an end portion of a fuse element portion is formed unitarily and in one piece with a terminal that is directly connectable to a battery. Accordingly, previously used fixing elements such as nuts and bolts can be eliminated. Further, the other end portion of the fuse element portion is formed unitarily and in one piece with a male tab that is connectable to a wire harness. Consequently, the fuse element portion and the wire harness can be easily connected without using any fixing elements. The number of parts used is thus reduced, and manufacturing costs are also lowered to a minimum. Besides, as the fixing elements are eliminated, spurious fitting during manufacture can be avoided, and the fuse box device as a whole can be miniaturized.

According to a second aspect of the invention, part of the fuse element portion is sandwiched by the holder, so that the fuse element portion is placed at a given position in the fuse box, and mounted therein. Accordingly, it is no longer needed to use the conventional means for fixing the fuse element portion in the fuse box. This feature also contributes to the reduction of parts number, costs and size.

According to a third aspect of the invention, upon mounting the fuse element portion into the fuse box, each male tab is inserted into a press-fitting terminal, through which the male tab is electrically connected to a wire harness. As a result, it is no longer necessary to use LA terminals and related fixing elements for binding the male tabs and the wire harness. Moreover, the press-fit terminals are separated from each other by an insulator wall, so that a short circuit between the press-fit terminals can be avoided. Furthermore, both the male tabs and the press-fit terminals are securely contained in a fuse box, so that they are better protected from external influences such as water contact.

According to a fourth aspect of the invention, the conductive fuse element portion is protected by molded resin. This molded resin makes the fuse element portion less susceptible to strain, and the fuse element portion procures a higher mechanical strength. At the same time, the molded resin improves the insulating and waterproof quality of the fuse box.

BRIEF DESCRIPTION OF THE DRAWINGS

The above and other objects, features and advantages of the present invention will be made apparent from the following description of the preferred embodiments, given as non-limiting examples, with reference to the accompanying drawings, in which:

FIGS. 2(*a*), (*b*), (*c*) and (*d*) illustrate a fuse unit of the present invention, respectively by a top plan view, a front elevational view, a side elevational view and a rear elevational view;

FIG. 7 is a bottom plan view of a cover joint forming part of the fuse cover of FIG. 6.

DETAILED DESCRIPTION OF THE PREFERRED EMBODIMENTS

Figure 1:
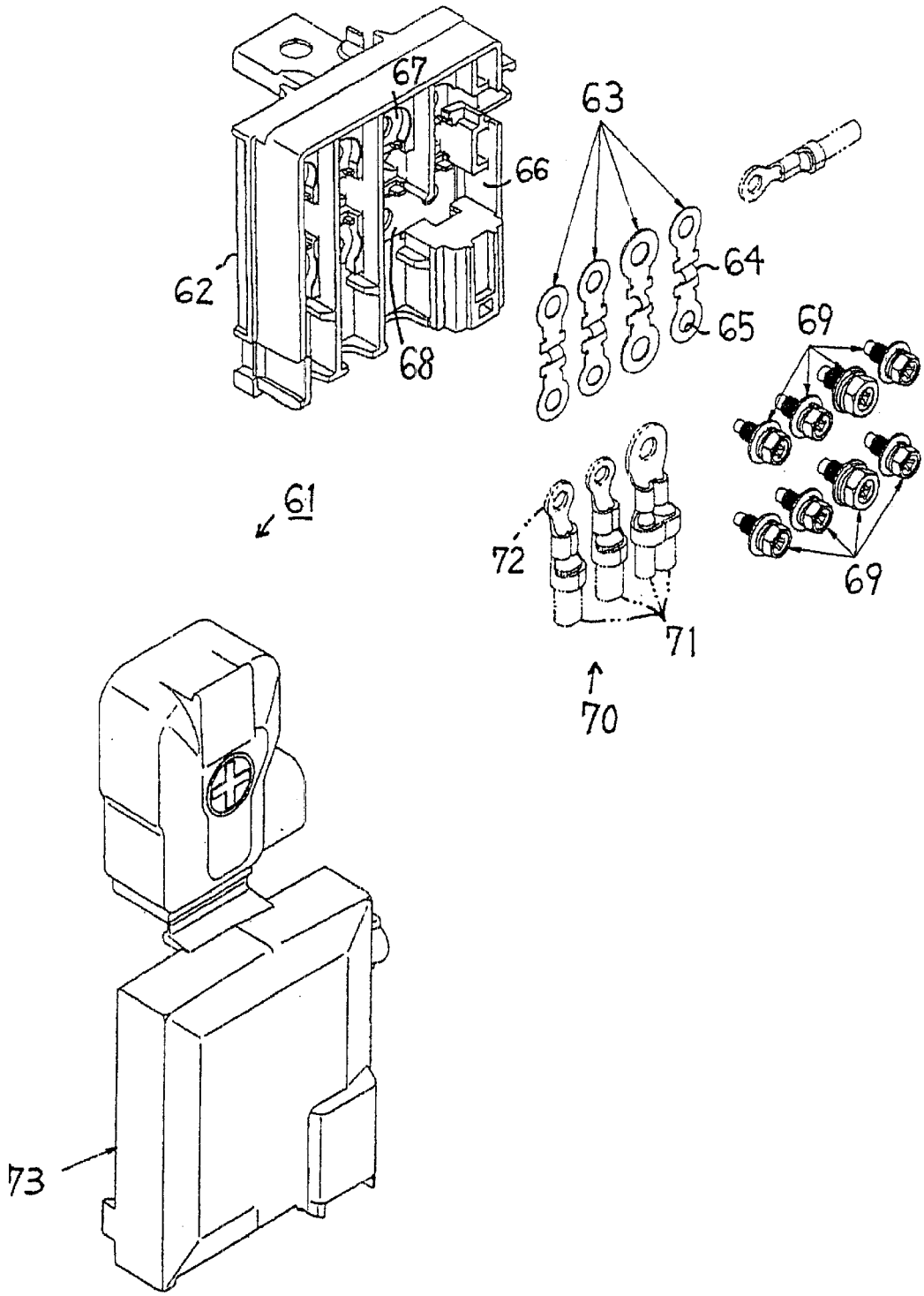
FIG.1 PRIOR ART
FIG. 1 is a perspective view of a disassembled fuse box device known in the prior art.

The fuse unit 1 constituting the fuse box device shown in FIG. 2 is formed of an electrically conductive plate, e.g. a metal plate. Examples of metals forming the electrically conductive plate include silver, copper, zinc, tin, lead and an alloy made with one or more of those metals. An input terminal 3 for a battery, output terminals 4 (male tabs) and fuse element portions 5 are formed unitarily and in one piece from the electrically conductive plate. The input terminal 3 is intended to be connected to a power-supply terminal of a car battery, and includes a first strip 3*a* (placed vertically in normal use) and a second strip 3*b* (placed horizontally in normal use). The first strip 3*a* is generally larger than the second strip 3*b*. One end of the second strip 3*b* (horizontal strip) is linked to the top end of the first strip 3*a* (vertical strip). The second strip 3*b* is formed into an inverted U-shape (note FIG. 2(*d*)), when viewed along its cross-section. A locus near the second end of the second strip 3*b*, and at a half-way point widthwise thereof, is provided with a substantially round hole 6 for bolting. The input terminal 3 can thus be fitted with a power-supply terminal by fixing a nut and bolt through the round hole.

The fuse unit 1 includes, e.g., four output terminals 4 (male tabs) and four fuse element portions 5. Each of the fuse element portions 5 is curved into substantially an S-shaped configuration, and has a width considerably narrower than that of a male tab 4. One end of the fuse element portion S is linked to the lower part of the first end of the second strip 3*b*. The other end of the fuse element portion 5 is linked to the top end of the male tab 4. Accordingly, the fuse element portion 5 connects the input terminal 3, connectable to a battery, to each male tab 4.

Part of the electrically conductive plate (i.e. the first strip 3*a* in its entirety and the upper zone of the male tabs 4) is coated by molding an insulator material, thereby forming an insulator-molded portion 7. Accordingly, the area including the fuse element portions 5 is molded with the insulator material. The latter has a thin, plate-like shape. The insulator material used in the invention may be formed of any suitable material, e.g., a resin such as epoxy resin. A predetermined locus in the insulator material is provided with four openings 8 having, e.g., a square shape. Through these openings 8, the fuse element portions 5 are exposed to the outside of the insulator material. The fuse unit 1 shown in FIG. 2 takes a rake-like form, that is, one input terminal 3, directly connectable to a battery, branches into four male tabs 4.

Figure 3:
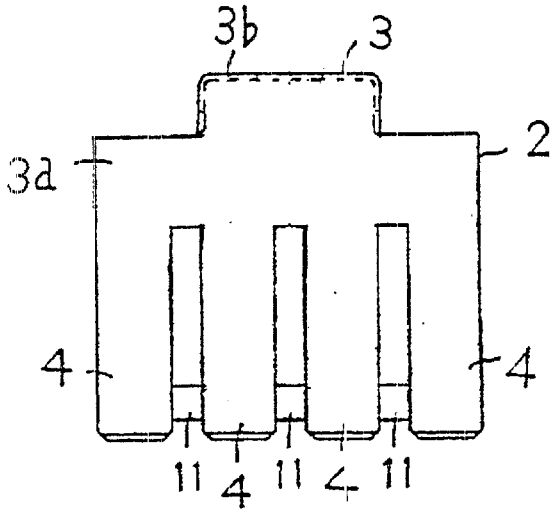
FIGS. 3(*a*), (*b*) and (*c*) are respective front elevational views of the inventive fuse unit, at different stages of manufacture explaining how the fuse unit is made.
Figure 3:
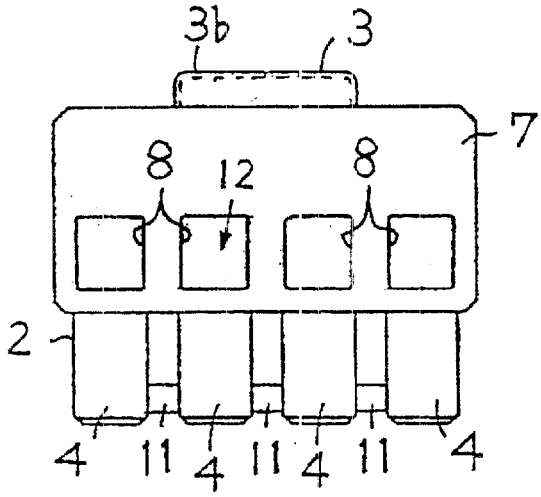
Figure 3:
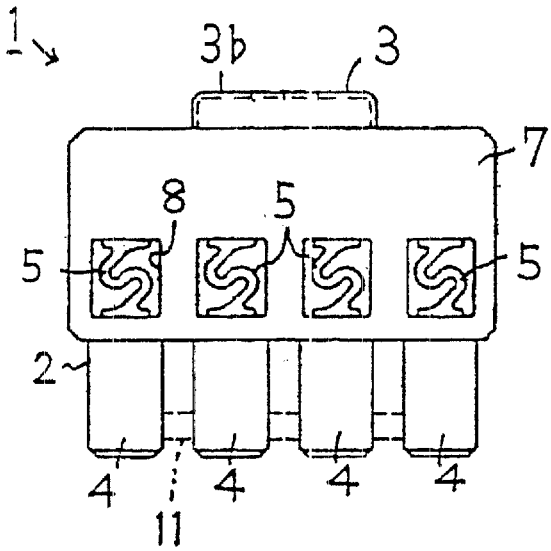

The fuse unit 1 is manufactured according to the steps shown in FIG. 3 (*a*), (*b*) and (*c*). First, a non-transformed electrically conductive plate 2 is prepared. The conductive metal plate 2 is then stamped out to yield, integrally, an input terminal 3 for battery connection, four male tabs 4 and three tie bars 11. The tie bars 11 may have the same thickness as the conductive metal plate 2, but they may also be made thinner, for example by half-etching. Preferably, each tie bar 11 is formed at a position uncovered by the insulator material, e.g. at an end portion of the male tab 4. Further, the bolt hole 6 may be formed at the same time as the conductive metal plate 2 is stamped out.

The conductive metal plate 2 is then transformed into a piece having a side cross-section of substantially an L-shaped configuration by bending using a particular bending tool. An area, which includes loci intended to subsequently house the fuse element portions 5 (element-forming locus 12), is initially insert-molded with an insulator material. At the same time, insulator openings 8 are formed in the insulator material, so that only the element-forming loci 12 are exposed to the outside through the insulator openings 8. To form the insulator openings 8, the insert-molding die may carry, e.g., convexities which are prepared in advance and configured to form such openings.

The exposed element-forming loci 12 are then stamped out so as to form four fuse element portions 5 and, at the same time, to remove the three tie bars 11. The male tabs 4 are thus separated from each other to form a desired fuse unit 1 shown in FIG. 2(*a*), (*b*) and (*c*).

Figure 4:
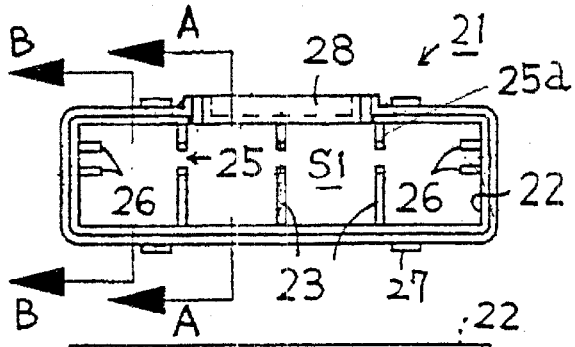
FIGS. 4(*a*), (*b*), (*c*) and (*d*) illustrate a fuse box according to the present invention, respectively by a top plan view, a front elevational view, a side elevational view and a rear elevational view.
Figure 4:
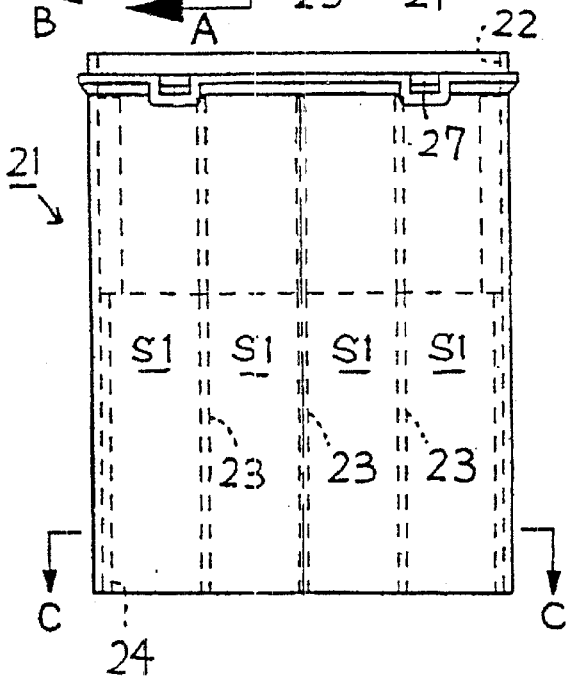
Figure 4:
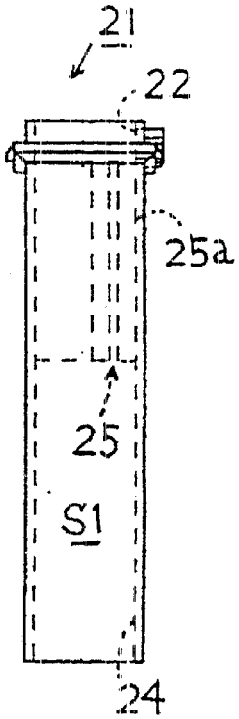
Figure 4:
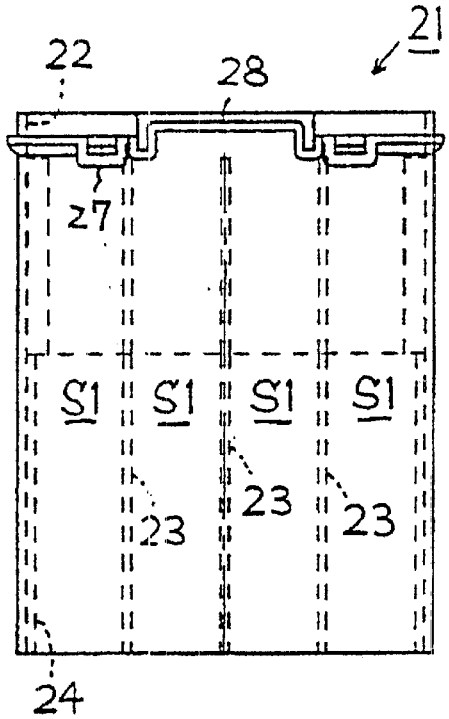

The fuse unit 1 thus produced is inserted into a fuse box 21, shown in FIGS. 4(*a*), (*b*), (*c*) and (*d*), prior to use. The fuse box 21 is formed of any suitable insulating material, for example, by molding, and has a generally rectangular tubular shape. The insulating material used may include resin materials including an insulator resin such as ABS resin.

The fuse box 21 has a generally rectangular top opening 22 and a similarly configured bottom opening 24. The outside rim portion of the top opening 22 is provided unitarily and in one piece with a plurality of first fixing mounts 27 and a flat fixing portion 28. When the fuse unit 1 is installed into the fuse box 21, the second strip 3*b* of the fuse unit 1 is placed on the flat fixing portion 28 and maintained thereon. In this condition, the second strip 3*b* extends outwardly from the fuse box 21. Accordingly, even when the fuse unit 1 is inserted into the fuse box 21, the input terminal 3 is directly connectable to a power-supply terminal of a battery.

Figure 5:
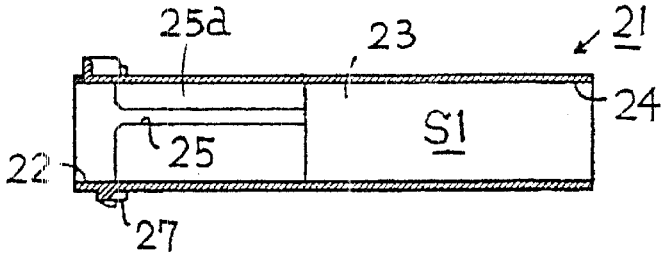
FIGS. 5(*a*), (*b*) and (*c*) are respective cross-sectional views taken along line A—A of FIG. 4(*a*), a cross-section along line B—B of FIG. 4(*a*), and a cross-section along line C—C of FIG. 4(*b*)
Figure 5:
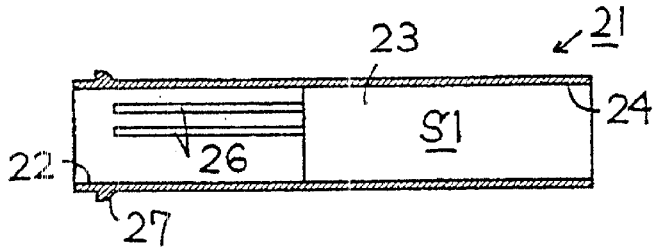
Figure 5:
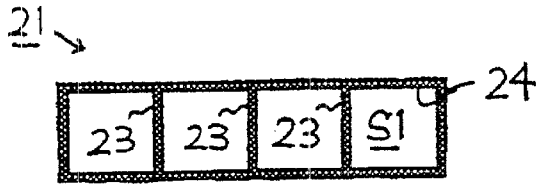

The inside space of the fuse box 21 is provided with insulator partition walls 23. In the present embodiment, the fuse-box inside space is divided into four enclosures by three insulator partition walls 23. The partition walls 23 are formed unitarily and in one piece with the fuse box 21 of the same insulating material, e.g., a resin. These walls 23 extend from the top to the bottom of the fuse box 21 in parallel relation to each other, with a constant interval therebetween. The three partition walls 23 thus form four enclosures S1, each of which can house a rectangular collinear press-fit terminal (not shown in the figures). Preferably, a portion of the inner face of fuse box 21 contained in each enclosure SI is provided with a lance structure (not shown) in order to secure the press-fit terminal. The bottom orifice 24 has four substantially square openings (note FIG. 5(*c*)). The other end of the press-fit terminal is further press-fitted with an electrical cable that forms a wire harness.

Figure 8:
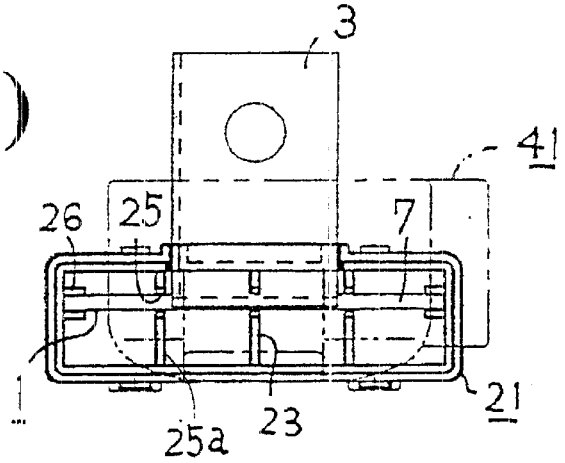
FIGS. 8(*a*), (*b*) and (*c*) illustrate the fuse unit of the present invention when contained in the fuse box, respectively by a top plan view, a front elevational view and a side elevational view.
Figure 8:
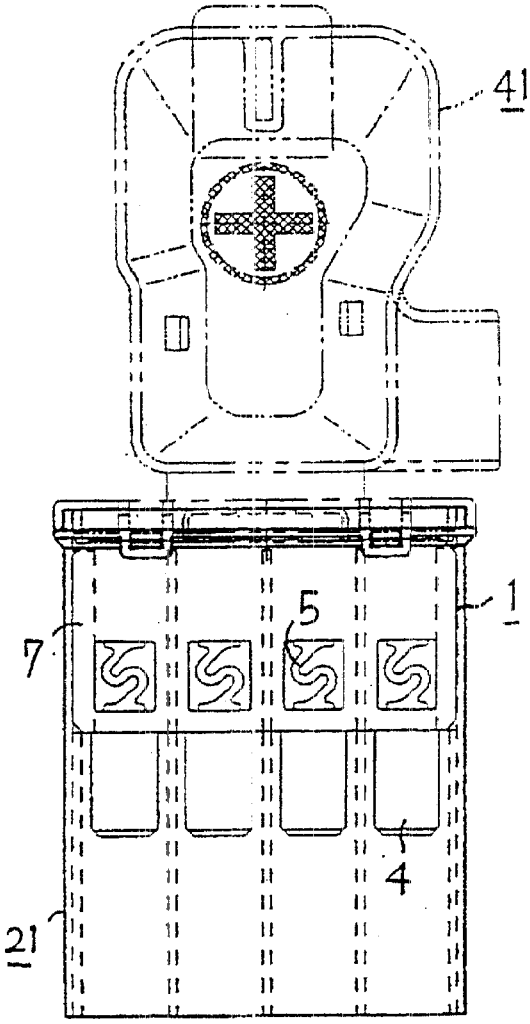
Figure 8:
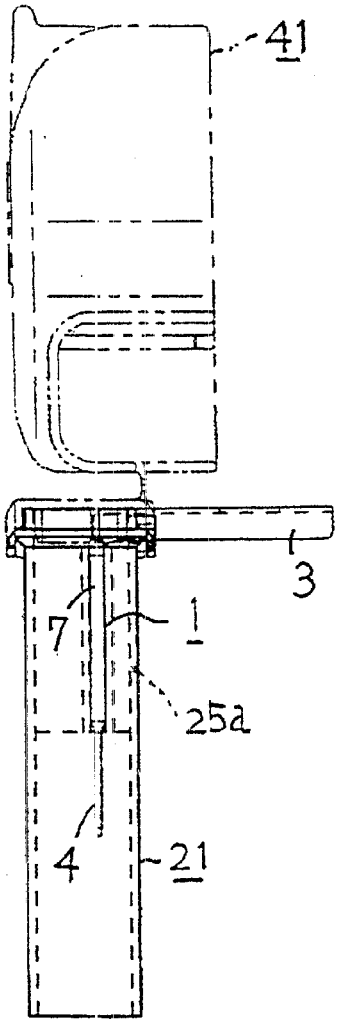

A top portion of each partition wall 23 is provided with a slit 25 extending from the top to a point about half-way down. The width of the slit 25 substantially corresponds to the thickness of the insulator-molded portion 7 of the fuse unit 1, so that the fuse unit 1 is held in the fuse box 21 by inserting the insulator-molded portion 7 into the slit 25 (see FIGS. 8(*a*)–(*c*)). The fuse unit 1 is thus placed and fixed at a predetermined position in the fuse box 21.

In other words, the slit-forming locus 25*a* in a partition wall 23 holds the fuse unit 1 by flanking a part of the front and rear faces of the insulator-molded portion 7. The slit-forming locus 25*a* thus serves as a first holder for positioning and fixing the fuse unit 1.

Two opposing positions on the small inner surfaces of the fuse box 21, corresponding to the positions of the slits 25, are provided with a respective pair of guide ribs 26. The two pairs of guide ribs 26 extend in parallel relation to each other, from the top of the fuse box 21 to a point about half-way down. These guide ribs 26 are formed unitarily and in one piece of a resin material with the fuse box 21. The space between the two guide ribs 26 of each pair is arranged to correspond to the thickness of the insulator-molded portion 7 of the fuse unit 1. As a result, the fuse unit 1 can be fixed at a predetermined position in the fuse box 21.

In other words, each pair of guide ribs 26 places and fixes the fuse unit 1 at a predetermined position by holding two ends of the insulator-molded portion 7. The guide ribs 26 thus serve as a second holders, as well as a guide for guiding the fuse unit 1 when it is inserted into the fuse box 21.

Figure 6:
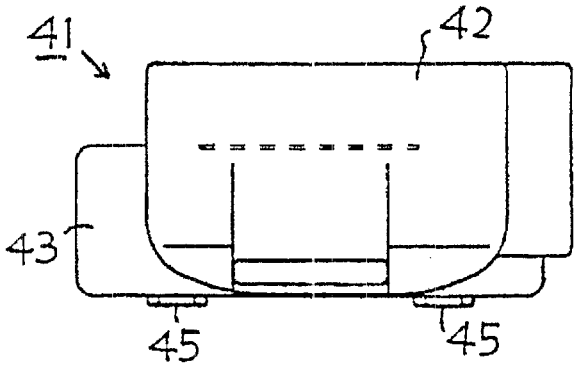
FIGS. 6(*a*), (*b*), (*c*), (*d*) and (*e*) illustrate a fuse cover of the inventive fuse box device, respectively by a top plan view, a front elevational view, a cross-sectional view along line D—D of FIG. 6(*b*), a side elevational view and a rear elevational view.
Figure 6:
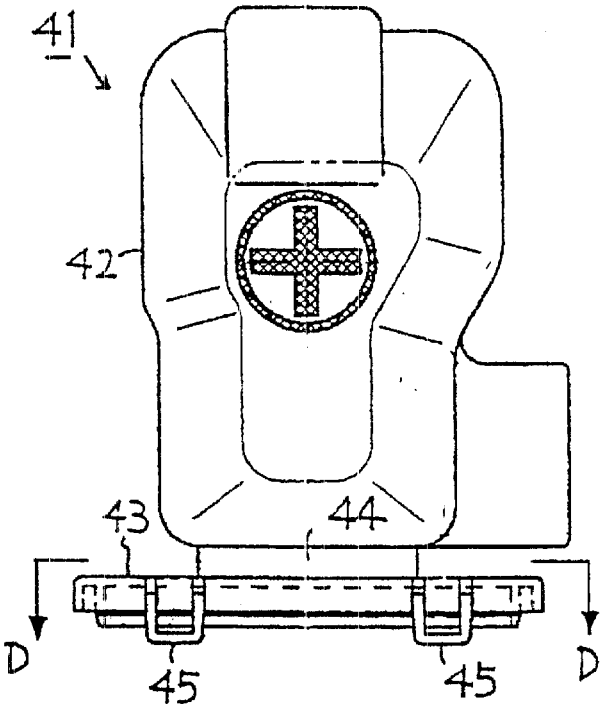
Figure 6:
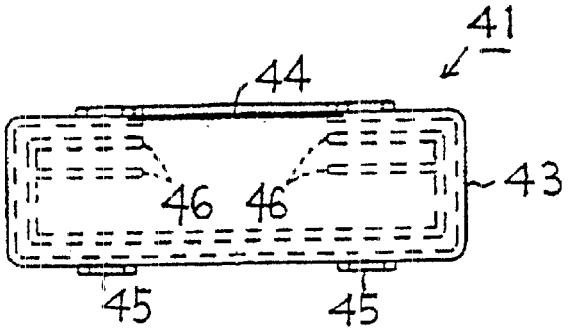

FIGS. 6(*a*)–(*c*) and 7 show a fuse cover 41 for protecting the fuse unit 1. The fuse cover 41 is made of any suitable material, e.g., a resin. The fuse cover 41 includes a cover plate 42, a cover joint 43 and a hinge portion 44 connecting the cover plate and cover joint. The cover plate 42 covers the power-supply terminal connectable to a battery mounted in an automobile, and protects the terminal from water and dust. The top face of the cover plate 42 is provided with a mark (FIG. 6(*b*)) to show that it encloses a power-supply terminal. The cover joint 43 is installed so as to close the top opening 22 of the fuse box 21. The cover joint 43 carries unitarily formed second fixing mounts 45 at positions corresponding to those of the respective first fixing mounts 27.

Accordingly, when the fuse cover 41 is placed on the fuse box 21, the second fixing mounts 45 are hooked by the first fixing mounts 27. The cover joint 43 is thus securely fixed onto the top opening 22 (see FIG. 8(*b*)).

There also are provided two pairs of cover ribs 46 in the underside of the cover joint 43 (see FIG. 7). The space between the cover ribs 46 is designed to be substantially the same as the thickness of the insulator-molded portion 7 of the fuse unit 1. Accordingly, when the fuse unit 1 is installed into the fuse box 21 and the fuse cover 41 is placed thereon, the two top ends portions of the insulator-molded portion 7 are held by the two pairs of cover ribs 46 (see FIG. 8). In this manner, the fuse unit 1 can be placed at a predetermined position in the fuse box 21 and securely fixed therein.

The cover ribs 46 thus hold parts of fuse unit 1, i.e., the upper edge portion of the insulator-molded portion 7, and fix the fuse unit 1 at a predetermined position. The cover ribs 46 thus serve as a third holder of the fuse unit 1.

The cover joint 43 provided with cover ribs 46 prevents the fuse unit 1 from being inadvertently drawn out of the fuse box 21. It also protects the fuse element portions 5 from water and dust.

As can be understood from the foregoing description, the present invention provides the following advantages.

In the fuse unit 1 of the present invention, an input terminal 3, directly connectable to a battery, is formed unitarily and in one piece with four fuse element portions 5 at one end thereof. Accordingly, it is no longer necessary to provide fixing elements, such as nuts and bolts, to fix the fuse elements portions 5 to the input terminal 3. Further, the other ends of the four fuse element portions 5 are also formed unitarily and in one piece with output terminals 4 (male tabs) for wire harness connections. Accordingly, the fuse element portions 5 and the wire harness can be connected easily without using fixing elements such as nuts and bolts. From the foregoing, the fuse box 21 of the present invention needs a fewer number of spare parts, and can be manufactured at lower costs.

As the fixing elements have been eliminated, there will be no spurious fixing such as skewed fixing or omitted fixing. Production control for such fuse boxes thus becomes much easier, and the production efficiency is improved. Large scale installations for bolting are also rendered unnecessary, thereby preventing an increase of equipment costs.

Furthermore, the use of nuts, which is a determinant in the size of the fuse box 21, is eliminated. The new structure without nuts thus greatly assists the miniaturization of the fuse box 21.

The fuse box 21 contains first and second holders which position and fix the fuse unit 1 by tightly engaging portions of fuse unit 1. By virtue of these holders, the fuse unit 1 is fixed at a predetermined position in the fuse box 21. Accordingly, use of the bindings, otherwise required for fixing the fuse units, are eliminated. A reduction in the number of spare parts used, lowering of costs, and miniaturization of the fuse box 21 can thus be achieved simultaneously.

The inside of the fuse box 21 of the present invention is provided with insulator partition walls 23, which define four terminal enclosures S1 for containing four male tabs 4. Accordingly, when the fuse unit 1 is inserted into the fuse box 21, each male tab 4 is fitted into a corresponding press-fit terminal (not shown). The male tab 4 is thus electrically connected to the wire harness through the press-fit terminal. Accordingly, it is no longer required to use LA terminals (or ring terminals) and the fixing elements thereof, which were otherwise used for connecting the male tab 4 to the wire harness. The advantage of using the press-fit terminals is that connections to the wire harness are made merely by press-fitting, without recourse to fixing elements.

Each press-fit terminal is separated from the other by an insulator partition wall 23, so that a short circuit between the press-fit terminals can be avoided from the outset. The partition walls 23 thus contribute greatly to the reliability of the fuse box 2l.

Both the male tabs 4 and the press-fit terminals are housed in the fuse box 21, and are thus not exposed to the outside influences such as water splash. The reliability of the fuse box 21 is thus further improved.

The fuse box 21 of the present invention includes first, second and third holders. These holders engage and hold several positions of the fuse unit 1, so that the latter can be securely placed at a predetermined position and fixed thereto in the fuse box 21. By virtue of this construction, the fuse box 21 better resists shocks and vibrations, and its reliability is improved.

In the inventive fuse unit 1, the area including the fuse element portions 5 is resin molded. In other words, the conductive fuse element portions 5 are protected with the insulator material. The fuse element portions 5 are thus less susceptible to strain, and the fuse unit 1 provides a higher mechanical strength. Further, the insulator material ensures better insulating and waterproof properties.

The number of male tabs 4 used as output terminals may be also one, two or three. It may also be more than four. The form of male tabs 4 may also be modified as desired. Likewise, the input terminal 3 may have a configuration other than that described above, or may not include the hole 6 for bolting. The fuse unit 1 itself may have a shape other than a rake-like shape.

The insulator material used is not limited to the above-mentioned resin or molded resin, but may be, e.g., rubber. Likewise, the insulator may be formed by a method other than the insert-molding. The fuse unit 1 may also not include an insulator material such as the molded resin.

The fuse box 21 may further be made without one or two of the first, second and third holders. The configuration of the holders may be changed.

Further technical concepts of the present invention will be made apparent from the following description.

The terminal directly connectable to a battery may relate to a power-supply terminal for a battery mounted in an automobile.

The holders may include a slit formed in a partition wall such as to extend from the top of the wall to a point about half-way down. The insulator-molded portion of the fuse unit may then be inserted into the slit, so that the base unit is placed at a predetermined position and securely held by the slit.

The holders may include two pairs of guide ribs formed on the inner face of the opposing ends of the fuse box, at positions corresponding to those of the slits. The guide ribs sandwich two side edges of the insulator-molded portion of the fuse unit, so that the fuse unit is placed at a predetermined position and fixed thereto.

The fuse box may include a fuse cover made of an insulator material. The fuse cover may include a cover plate which covers the part of fuse unit extending outwardly from the fuse box, a cover joint which covers the top opening of the fuse box, and a hinge portion linking the cover plate and the cover joint.

The inside face of the cover joint may include a holder which can sandwich part of the fuse unit, and fix its position.

The fuse box device may include a fuse unit and fuse box. Further, the fuse box may include holders which flank the fuse unit, fix its position and hold it securely.

The fuse unit in the above fuse box device may include a terminal directly connectable to a battery, several fuse element portions and several male tabs connectable to a wire harness. The fuse box in the above fuse box device may include insulator partition walls which form enclosures for a respective press-fit terminal. Each enclosure then receives a male tab.

The fuse box device according to a first embodiment of the present invention utilizes a reduced number of spare parts, compared to the known fuse box devices. Production costs therefore are lower, and the fuse box is better suited to miniaturization and is less susceptible to assembling errors.

The holders according to a second embodiment of the invention further contribute to reducing the number of spare parts, lowering production costs and miniaturizing the fuse box device.

The partition walls according to a third embodiment of the present invention ensure an electrically reliable functioning for the fuse box device.

The insulator-molded portion according to a fourth embodiment of the present invention provide the fuse box device with greater mechanical strength, greater electrical insulation, and greater waterproofness than known devices.

Although the invention has been described with reference to particular means, materials and embodiments, it is to be understood that the invention is not limited to the particulars disclosed and extends to all equivalents within the scope of the claims.

The present disclosure relates to subject matter contained in priority Japanese Applications Nos. HEI 11-345350, filed on Dec. 3, 1999, and HEI 11-346240, filed on Dec. 6, 1999, the disclosures of which are both herein expressly incorporated by reference in their entireties.

What is claimed:

1. A fuse box device comprising a fuse unit and a fuse box, said fuse unit including at least one fuse element portion having a first end portion and a second end portion, said first end portion being formed unitarily and in one piece with an input terminal directly connectable to a battery, said second end portion being formed unitarily and in one piece with at least one output terminal connectable to a wire harness, said fuse unit being contained in said fuse box such that only at least part of said input terminal is positioned outside said fuse box.

2. The fuse box device according to claim 1, wherein said fuse box comprises at least one holder that defines a fixing position for said fuse unit and that fixes said fuse unit in said fuse box by holding part of said fuse unit.

3. The fuse box device according to claim 2, wherein said part of said fuse unit comprises said insulator-molded portion.

4. The fuse box device according to claim 2, wherein said fuse box comprises two opposing inner faces, said insulator partition walls have a top portion, and said fuse box device further comprises a cover joint having an inner face, wherein said at least one holder is selected from the group consisting of:

at least one slit formed in said insulator partition walls so as to extend from said top portion thereof to a point about half-way down;

two pairs of ribs formed in said opposing inner faces of said fuse box at positions corresponding to those of said slits; and two pairs of ribs formed in said inner face of said cover joint at positions corresponding to those of said slits.

5. The fuse box device according to claim 4, wherein said part of said fuse unit comprises said insulator-molded portion.

6. The fuse box device according to claim 1, wherein said at least one output terminal comprises a plurality of output terminals and said fuse box contains at least one insulator partition wall configured to define a plurality of enclosures, so that each of said enclosures contains said output terminal connectable to a press-fit terminal of one electrical cable which constitutes the wire harness.

7. The fuse box device according to claim 6, wherein said fuse box comprises at least one holder that defines a fixing position for said fuse unit and that fixes said fuse unit in said fuse box by holding part of said fuse unit.

8. The fuse box device according to claim 7, wherein said part of said fuse unit comprises said insulator-molded portion.

9. The fuse box device according to claim 7, wherein said fuse box comprises two opposing inner faces, said insulator partition walls have a top portion, and said fuse box device further comprises a cover joint having an inner face, wherein said at least one holder is selected from the group consisting of:

at least one slit formed in said insulator partition walls so as to extend from said top portion thereof to a half-way point downwards;

two pairs of ribs formed in said opposing inner faces of said fuse box at positions corresponding to those of said slits; and two pairs of ribs formed in said inner face of said cover joint at positions corresponding to those of said slits.

10. The fuse box device according to claim 9, wherein said part of said fuse unit comprises said insulator-molded portion.

11. The fuse box device according to claim 1, wherein said fuse unit comprises an insulator-molded portion covering at least around said fuse element portions.

12. The fuse box device according to claim 11, wherein said at least one output terminal comprises a plurality of output terminals and said fuse box contains at least one insulator partition wall configured to define a plurality of enclosures, so that each of said enclosures contains said output terminal connectable to a press-fit terminal of one electrical cable which constitutes the wire harness.

13. The fuse box device according to claim 11, wherein said fuse box comprises at least one holder that defines a fixing position for said fuse unit and that fixes said fuse unit in said fuse box by holding part of said fuse unit.

14. The fuse box device according to claim 13, wherein said part of said fuse unit comprises said insulator-molded portion.

15. The fuse box device according to claim 13, wherein said fuse box comprises two opposing inner faces, said insulator partition walls have a top portion, and said fuse box device further comprises a cover joint having an inner face, wherein said at least one holder is selected from the group consisting of:

at least one slit formed in said insulator partition walls so as to extend from said top portion thereof to a point about half-way down two pairs of ribs formed in said opposing inner faces of said fuse box at positions corresponding to those of said slits; and two pairs of ribs formed in said inner face of said cover joint at positions corresponding to those of said slits.

16. The fuse box device according to claim 15, wherein said part of said fuse unit comprises said insulator-molded portion.

17. The fuse box device according to claim 12, wherein said fuse box comprises at least one holder that defines a fixing position for said fuse unit and that fixes said fuse unit in said fuse box by holding part of said fuse unit.

18. The fuse box device according to claim 17, wherein said part of said fuse unit comprises said insulator-molded portion.

19. The fuse box device according to claim 17, wherein said fuse box comprises two opposing inner faces, said insulator partition walls have a top portion, and said fuse box device further comprises a cover joint having an inner face, wherein said at least one holder is selected from the group consisting of:

at least one slit formed in said insulator partition walls so as to extend from said top portion thereof to a point about half-way down;

two pairs of ribs formed in said opposing inner faces of said fuse box at positions corresponding to those of said slits; and two pairs of ribs formed in said inner face of said cover joint at positions corresponding to those of said slits.

20. The fuse box device according to claim 19, wherein said part of said fuse unit comprises said insulator-molded portion.

* * * * *